United States Patent [19]

Britz

[11] Patent Number: 4,654,904

[45] Date of Patent: Apr. 7, 1987

[54] INVALID CHAIR

[76] Inventor: Elizabeth A. Britz, 2303 1st St., New Port Richey, Fla. 33552

[21] Appl. No.: 783,046

[22] Filed: Sep. 30, 1985

Related U.S. Application Data

[63] Continuation-in-part of Ser. No. 622,043, Jun. 19, 1984, abandoned.

[51] Int. Cl.[4] ..... A61G 7/08

[52] U.S. Cl. ..... 5/81 R; 5/90; 297/DIG. 4

[58] Field of Search ..... 5/37 R, 41–44 R, 5/44 B, 66, 68, 77, 80, 81 R, 90; 297/343, 378, DIG. 4, 355

[56] References Cited

U.S. PATENT DOCUMENTS

| | | | |
|---|---|---|---|
| 355,854 | 1/1887 | Baker | 297/355 |
| 1,288,670 | 12/1918 | Pfanschmidt | 297/355 |
| 2,165,529 | 7/1939 | Barie | 297/DIG. 4 |
| 2,312,602 | 3/1943 | Taylor | 297/DIG. 4 |
| 3,038,174 | 6/1962 | Brown et al. | 5/90 |
| 3,039,821 | 6/1962 | Black et al. | 297/343 |
| 3,069,202 | 12/1962 | Gottfried et al. | 297/355 |
| 3,512,187 | 5/1970 | Thomas et al. | 297/DIG. 4 |
| 3,654,643 | 4/1972 | Clanan | 5/81 B |
| 3,860,285 | 1/1975 | Hartman | 297/DIG. 4 |
| 3,887,228 | 6/1975 | Ingerson | 297/DIG. 4 |
| 4,013,135 | 3/1977 | Kechely | 297/417 |

*Primary Examiner*—Gary L. Smith
*Assistant Examiner*—Michael F. Trettel
*Attorney, Agent, or Firm*—Joseph C. Mason; Herbert W. Larson

[57] ABSTRACT

An invalid chair is disclosed which has four legs of tubular material with lockable castors mounted in the bottom of the legs. The two rear legs extend upwardly beyond the seat support area and then backwardly to be interconnected for support of a semi-reclining back which is rotatably mounted at its back on the cross member which connects the tops of the two back legs at the seat support area. Two outwardly swingable arm rests are attached at an appropriate position on the upward extensions of the rear legs. The front ends of the arm rests are detachably latched at the front of the chair. An adjustable leg support is pivotally mounted between the stanchions. An opening is provided with a hingeably mounted trap-door in the middle of the seat for toilet use. The horizontal portions of the arm rests can accommodate a hospital tray. A handlebar may be attached to the back support. All body contact areas are provided with vinyl webbing and appropriate removable and washable cushions. Outwardly rotatable individual foot supports may be constructed at the lower end of the adjustable leg support. The tubular construction material may be of steel reinforced vinyl tubing.

8 Claims, 5 Drawing Figures

INVALID CHAIR

PRIOR APPLICATION

This application is a continuation-in-part of U.S. Application Ser. No. 622,043, filed June 19, 1984 now abandoned.

BACKGROUND OF THE INVENTION

1. Field of the Invention

This invention relates to chairs employed specifically for invalid persons. More particularly it refers to invalid person chairs having tubular components separated by webbing and being adaptable for showering, toilet events, feeding and general utility use.

2. The Prior Art

Many patents describe invalid chairs such as U.S. Pat. Nos. 4,393,529; 4,013,135; 3,887,278; 3,860,285; 3,654,643; 3,512,187; 3,039,821; 3,038,174; 2,312,602; and 2,165,529. These chairs have structures enabling them to function for limited events, but generally are not structured to be useful for multiple patient events.

Bedridden patients are in need of some sort of rolling chair to which they may be easily transferred from their bed for toilet, shower, or general aid with the activities of daily living, and back to the bed. In particular, invalids and other chronically ill persons who are bedridden require specialized care to prevent the formation of pressure sores or decubiti. Proper care for such patients includes providing good air flow around the patient and assisting the patient in moving from one position to another, where possible. Patients who are obese, severely arthritic, or who are recovering from recent surgery, have difficulty reorienting their bodies and find it nearly impossible to sit up. Since it is known that the action of moving the patient can prevent complications such as hypostatic pneumonia, large scale apparatus such as motorized hospital beds have been employed to introduce a certain artificial mobility to the body parts. What is needed, however, is a simpler technique to easily transfer the bedridden patient from the bed to a seated position. Even more beneficial would be a mechanism for easily transferring the bedridden patient from the bed to a wheelchair to enable a change of scene out of the hospital room.

OBJECT OF THE INVENTION

It is therefore an object of the invention to provide an improved means for supporting a bedridden patient while articulating his body parts.

It is another object of the invention to provide an improved means to assist a bedridden patient to assume a seated position.

It is still a further object of the invention to provide an improved means to transfer a patient from his bed to a seated position in a chair.

It is a still a further object of the invention to provide an improved means to transfer a patient from his bed to a mobile chair.

It is still a further object of the invention to provide an improved means to comfortably transfer a bedridden patient from his bed to a seated position at a toilet.

It is still a further object of the invention to provide an improved means to transfer a bedridden patient from a mobile chair back to this bed.

SUMMARY OF THE INVENTION

The chair of the present invention provides a one-part chair embodying a semi-reclining, comfortable, back support which is supported by a crossbar integrated into the basic chair structure. The back support is hingeably mounted at its base and can conveniently be folded forwardly onto the seat. Outwardly swingable are rests provide for easy access and egress by the patient. The arm rests also provide for attachment of the conventional hospital tray. A central opening in the seat, provided with a hinged "trap door" is arranged for backing the chair over a conventional toilet. An adjustable leg rest is appropriately pivotally mounted at the front of the seat and also carries outwardly rotatable foot support at its lower end.

DESCRIPTION OF THE FIGURES

These and other objects, features, and advantages of the invention will be more fully appreciated with reference to the accompanying figures.

DISCUSSION OF THE PREFERRED EMBODIMENTS

Figure 1:
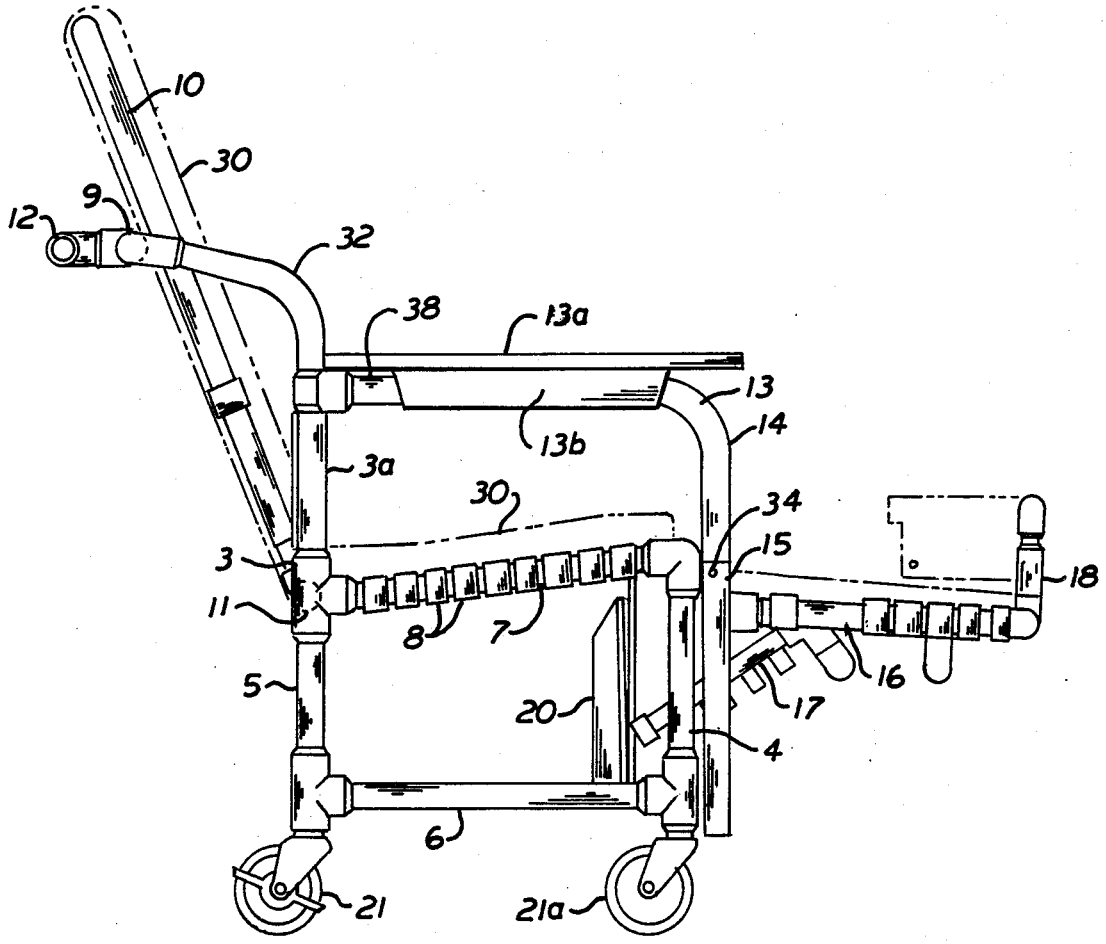
FIG. 1 is a side view of the chair.
Figure 3:
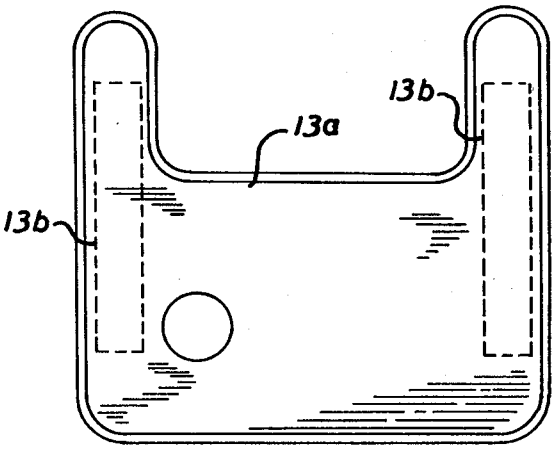
FIG. 3 illustrates the hospital tray.

An invalid chair is disclosed which has four legs of tubular material with lockable castors mounted in the bottom of the legs. Alternatively, the front wheels 21*a* can be fixed in a position parallel to the horizontal members discussed below. The two rear legs 5 extend upwardly beyond the seat support area and then backwardly to be interconnnected for support of a semi-reclining back which is rotatably mounted at its back on the cross member 11 which connects the tops of the two back legs at the seat support area. Two outwardly swingable arm rests 13 are attached at an appropriate position on the upward extensions of the rear legs. The front ends of the arm rests are detachably latched 34 to the upper ends of a pair of tubular stanchions 15 which are vertically attached to the front of the front legs 4. An adjustable leg support 17 is pivotally mounted between the stanchions. An opening is provided with a hingeably mounted trap-door 20 in the middle of the seat for toilet use. The horizontal portions 38 of the arm rests 13 can accommodate a hospital tray 13*a*. The tray 13*a* is snapped onto arm 13 by a pair of plastic arms 13*b* mounted under the tray. A handlebar 12 is attached to the back support. All body contact areas are provided with vinyl webbing 8 and appropriate removable and washable cushions 30. Outwardly rotatable individual foot supports 18 may be constructed at the lower end of the adjustable leg support 16. The tubular construction material may be of steel reinforced vinyl tubing.

Figure 4:
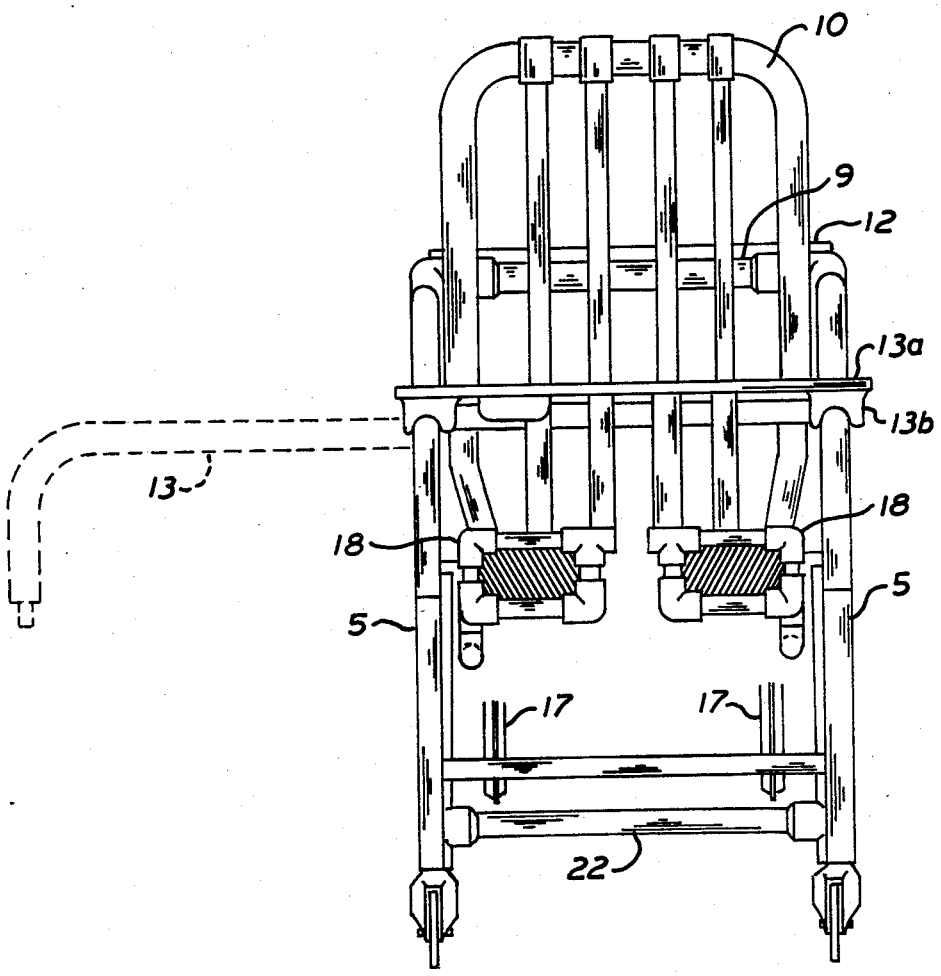
FIG. 4 is a front view of the chair.

The invalid chair, as a whole and one piece structure, is best seen in FIG. 1. Two similar side support frames 3, each have front and back vertical legs 4 and 5 respectively. The front and back legs of the support frames are joined at their lower ends by first horizontal tubular structural members 6. The tops of said vertical legs 4 and 5 are rigidly interconnected by second generally horizontal members 7 which slope gently downward toward the back. The sloping upper members 7 provide support for webbing 8, forming a seat over which a cushion 30 may be placed. Multiple horizontal tubular members 22, (FIG. 4), at right angles to the legs 4 and 5 join the two side support frames 3 in parallel rigid relationship. The vertical tubular back legs 5 extend vertically upwardly at 3*a* above the said area, then curve backwardly 32 to be interconnected with a horizontal crossbar 9 to provide support for the vinyl webbed semi-reclining back 10 which is foldably supported at the bottom near the seat area.

A handlebar 12 for pushing the chair is rotatably mounted on the crossbar 9. The ends of handlebar 12 rest on 32 when the backrest 10 is in a forward position (FIG. 5) and are rotated outwardly (FIG. 1) when the backrest 10 is in a reclined position.

Figure 2:
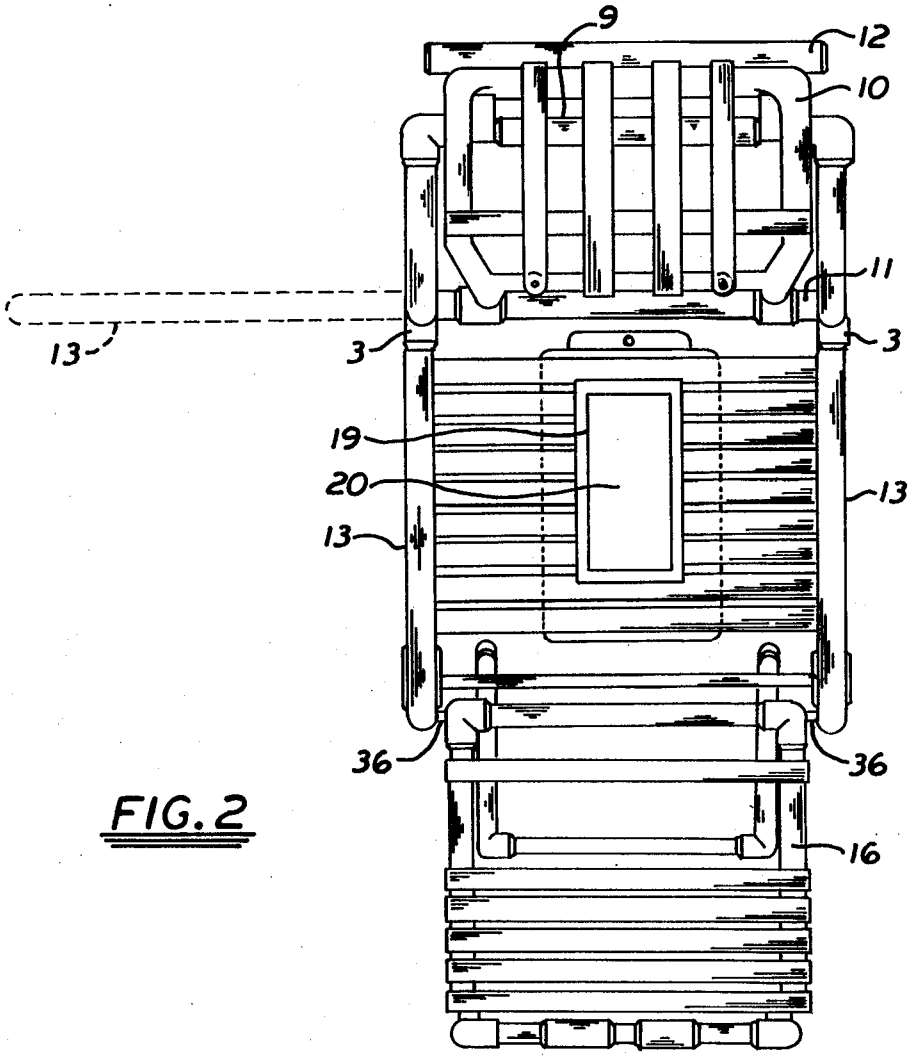
FIG. 2 is a plan view of the chair.

Arm rests 13, capable of supporting a standard hospital tray 13*a*, are mounted on the vertical upward extensions 3*a* of the back legs to swing outwardly for easy ingress and egress of the patient. The forward ends of the arm rests curve downwardly at 14 to latch 34 and meet the upper ends of a pair of tubular stanchions 15 which are rigidly secured to the front sides of the front legs 4 (FIG. 1). A vinyl-webbed, rectangular leg support 16 is pivotally mounted at an appropriate level between the stanchions 15. See pivots 36, FIG. 2. A pair of notched members 17 are provided for adjusting the angle of the leg support as desired. Outwardly rotatable individual foot supports 18 are mounted at the outer end of the leg support 16. See FIGS. 1 and 4.

An opening 19 is provided in the middle of the seat for toiletting purposes which may be closed by means of a hinged trap-door 20. Four easy rolling castors 21 (FIG. 1) are mounted in the bottom ends of the vertical tubular back and front legs for easy mobility of the chair and patient. The rolling castors are lockable in the usual manner.

Appropriate removable cushions 30 may be provided for the seat, back and leg support webbed areas of the chair.

The tubular structural members are made of water tolerant material such as vinyl clad, steel reinforced tubing so that the chair and patient may be rolled into and out of a shower bath without damage to the chair. As used herein, the term "webbing", as desired, shall include air-inflatable material or strips of fabric or vinyl.

Figure 5:
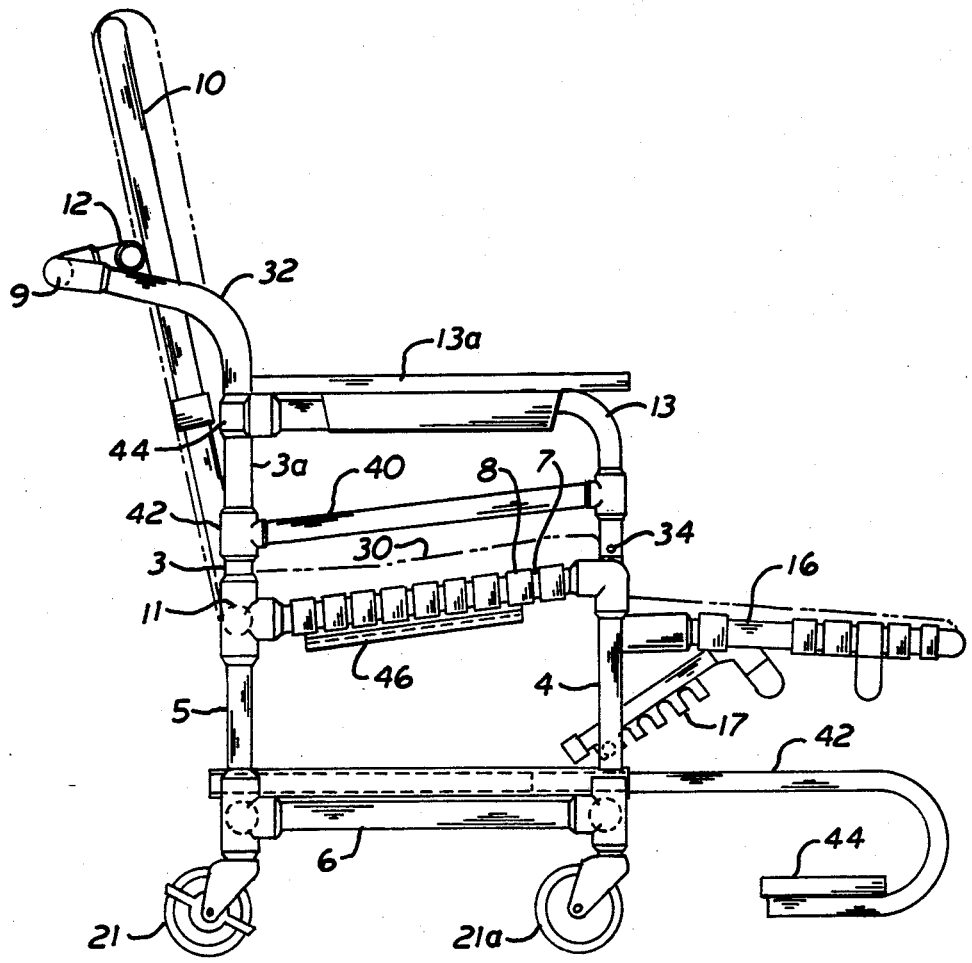
FIG. 5 is a side view of an alternate chair.

FIG. 5 shows an alternative embodiment of the invention where the outwardly pivotal arm rest 13 on each of support frames 3 is detachably engaged at 34 directly to the front leg 4 at the juncture with the front of the seat support horizontal member 7. The leg rest 16 is hinged on cross member 22 joining the two front legs 4. An added feature is the foot rest 44 which is mounted on a pair of telescoping U-shaped horizontal members 42. When not needed, foot rest 44 can be moved under the chair frame 3 by telescoping horizontal members 42, which are attached in the rear to legs 5 and in the front to legs 4. The front wheels 21*a* are mounted in a fixed position parallel to the horizontal tubular structural member 6. A flanged groove 46 is mounted on each under side of hole 20 so that a removeable toilet tray (not shown) can be slidably inserted and removed below hole 20. An optional additional horizontal support tube 40 joins the arm support 13 to the upper portion 3*a* of the back leg 5. The arm support 13 is hinged at 42 and 44 to allow outward movement after release from latch 34.

Although specific embodiments of the invention have been disclosed, it will be understood by those skilled in the art that minor changes can be made in the structural details of these embodiments without departing from the spirit and broad scope of the invention.

I claim:

1. In an invalid chair having a pair of side frames with front and rear vertical tubular legs interconnected by a first horizontal tubular member adjacent the bottom of the legs and a second tubular member adjacent the top of the legs gently sloping downward toward the back legs, webbing interconnecting the second tubular member on each side frame to form a seat, a third horizontal tubular member at right angles to and interconnecting the rear legs adjacent their top, the improvement comprising:

(a) a back support frame having a pair of tubular members extending upwardly from the top of the legs to an interconnection with a tubular arm rest and then further upwards and backwardly to an end portion where the pair of back support tubular members are interconnected with a first position tubular member at right angles to the pair of back support members, (b) a rotatable second position tubular member spaced apart but parallel to the first position tubular member and attached to the first position tubular member by a rotating sleeve so that rotation of the second position tubular member from a location below the first position tubular member to a position above the first position tubular member moves a back rest frame from a semi-reclining position to an upright position, the back rest frame being rectangular in shape and rotatably mounted on the third horizontal tubular member interconnecting adjacent the top of each back leg, the back rest frame resting on the first position tubular member in the semi-reclining position and on the second position tubular member in the upright position, (c) the tubular arm rests are each rotatably mounted to the back support frame at a back end and latchingly attached to the top of the front leg at a front end so that disengagement of the latch will allow the arm rest to swing outwardly from the chair, (d) a fourth horizontal tubular member interconnecting each front leg adjacent the bottom of the legs and (e) a fifth horizontal tubular member interconnecting each front leg adjacent the top of the legs.

2. An invalid chair according to claim 1 wherein the arm rests support a hospital tray for easy snap on attachment and removal.

3. An invalid chair according to claim 1 wherein there is a sixth horizontal tubular member interconnecting the front legs and positioned above the fourth horizontal tubular member, the sixth horizontal member engaging a racheted bar which supports a rectangularly shaped foot rest rotatingly suspended from the fifth horizontal tubular member.

4. An invalid chair according to claim 1, wherein the seat is provided with a centrally located opening for toiletting.

5. An invalid chair according to claim 4, wherein the opening for toiletting is closable by a trap door mounted on the underside of said seat.

6. An invalid chair according to claim 4, wherein a portable toilet receptacle is slidably mounted beneath the centrally located opening.

7. An invalid chair according to claim 1, wherein a wheel is attached to the bottom of each leg.

8. An invalid chair according to claim 1, where a pair of telescoping U-shaped members attached to the front and rear legs supports a foot rest in an extended position in front of the chair and in a retracted position under the chair.

* * * * *